US005384914A

United States Patent [19]

Caveness et al.

[11] Patent Number: 5,384,914

[45] Date of Patent: Jan. 31, 1995

[54] SPORTS FACE MASK

[75] Inventors: Lorine S. Caveness, Salem; Henry G. Glass, Roanoke; Alan B. Feldman, Salem, all of Va.

[73] Assignee: Face Guard, Inc., Salem, Va.

[21] Appl. No.: 191,151

[22] Filed: Jan. 14, 1994

[51] Int. Cl.[6] ..... A42B 1/08

[52] U.S. Cl. ..... 2/9; 2/424

[58] Field of Search ..... 2/9, 10, 11, 15, 410, 2/424, 425, 422, 173, 206; D29/106, 107

[56] References Cited

U.S. PATENT DOCUMENTS

| | | | |
|---|---|---|---|
| 2,020,249 | 11/1935 | Shibe | 2/9 |
| 2,502,377 | 3/1950 | Goldsmith et al. | 2/9 |
| 2,929,070 | 3/1960 | Novak . | |
| 2,944,263 | 7/1960 | Rayburn et al. . | |
| 3,113,318 | 12/1963 | Marietta . | |
| 3,216,023 | 11/1965 | Morgan | 2/9 |
| 3,886,596 | 6/1975 | Franklin et al. | 2/9 |
| 4,631,758 | 12/1986 | Newman et al. | 2/424 |
| 5,129,108 | 7/1992 | Copeland et al. | 2/424 |

*Primary Examiner*—Clifford D. Crowder
*Assistant Examiner*—Michael A. Neas
*Attorney, Agent, or Firm*—Olive & Olive

[57] ABSTRACT

A face mask formed of an impact resistant plastic material comprises interconnected horizontal and vertical bars and panel portions in arcuate configuration to surround the face of the wearer. Each bar is formed with front and rear outwardly curved surfaces which form boundaries of spaced apart, angularly related rib portions extending for the length of each bar.

10 Claims, 6 Drawing Sheets

SPORTS FACE MASK

BACKGROUND OF THE INVENTION

1. Field of the Invention

This invention relates to a mask to protect the face of a wearer from injury and more particularly to a mask incorporating a bar grid and molded of a plastic material for use in sports such as baseball and football.

2. Description of the Related Art

Protective clothing, especially protective masks have been used in sports such as ice hockey and football for many years. Examples of previously known face masks formed with a bar grid and adapted for use with football helmets, are seen in U.S. Pat. Nos. 2,929,070; 2,944,263; 3,113,318 and 4,631,758. The '263 patent refers to the bars being made of metal rod or synthetic plastic. The '070 and '318 patents refer to the bars being made of coated metal rod and the '070 patent refers to molding the entire face mask of plastic. The '758 patent also refers to forming the face mask of a flexible material.

Although the present invention is applicable to a variety of different sports it has particular significance for baseball. By way of background, baseball uses little in the way of protective clothing except for protection of the position of catcher. However, baseball helmets are especially needed for the vast number of youngsters whom often play in organized leagues such as in a Little League or Babe Ruth League. These youth leagues play with a conventional, relatively hard, baseball, but the players are necessarily less experienced and less agile in their playing capabilities than adult players. A young player, for example, can possibly be hit with a ball which bounces off the ground or by a ball thrown by the pitcher or other player and which could result in an injury.

Helmets have come into use to protect the head of a baseball player as shown in U.S. Pat. No. 3,886,596 and which patent also illustrates a face mask attached to the helmet and formed of a sheet-like plastic material. In those types of face masks mounted on helmets which are formed of protective bars, the protective bars typically have a round or modified circular cross-sectional shape. The '758 patent referred to above illustrates bars having a modified trapezoidal cross-sectional shape.

It has now been discovered that the round, modified circular and modified trapezoidal cross-sectional shaped bars are inadequate in many respects. In one respect, the bars are relatively heavy which can cause wearer physical discomfort and which may result in the wearer removing the helmet and attached mask thus exposing himself or herself to potential injury. In another respect, the traditional protective bar has a relatively large solid, circular or modified circular cross-sectional area, from surface to opposing surface the bar is relatively thick, and when molded of plastic has a tendency to promote air bubbles that are trapped inside as a result of the manufacturing-molding process. These bubbles in turn may cause the bar in which they are contained to fracture upon impact and thus expose the wearer to the forceful impact of the incoming object as well as possibly to incoming splintered face mask material. Thus, mask bars of conventional cross-sectional shape often lack the strength to adequately protect the wearer. Also, a substantial amount of material is used in bars of conventional cross-sectional shape which adds to the cost of the mask. In response to this need for improvement, the mask of the present invention provides a bar grid type face mask with protective bars of unique cross-sectional rib-like shape which can be made with less material at less cost, and made stronger than is the case with protective bars of traditional cross-sectional shape.

The present invention recognizes that by providing the player, particularly a young player, with a mask which tends to prevent injury to the face of the player, the player is able to play better, enjoy the game more and learn faster all as added benefits.

It is a therefore an object of this invention to provide an improved bar-type mask which protects the face of a young player from injury.

It is a further object of this invention to provide a face mask having protective bars which are lighter, are made from less material, and are stronger than previous face masks.

It is an additional object of this invention to provide a face mask which assists a player to better use his or her abilities by reason of reducing the likelihood of injury.

Other objects and advantages will be more fully apparent from the following disclosure and appended claims.

SUMMARY OF THE INVENTION

The invention provides a face mask formed with a bar grid and which can be secured to a helmet to protect the head and face of a player. The mask of the invention is especially useful for young baseball players and is made from a plurality of horizontal bars which span from one side to the other side of the face of the player and cover the face from above the tip of the nose to the chin. The lowest of the horizontal bars is appended to and is formed integral with a substantially solid lower section chin panel protective of the jaw and lower pallet areas of the wearer. The horizontal bars are held in spaced relation by several vertical connecting bars or by a connecting panel. The horizontal bars, and optionally also the vertical bars, have a front forwardly oriented curved surface continuous with a rear curved surface. The surfaces of each bar are shaped so as to define at least two opposed, spaced apart rib portions which extend for the length of the bar. The bars in the face mask of the invention, unlike those in the prior art masks, are shown by way of illustrative embodiments as having essentially a "U", "V" or "T" shaped cross-section. In all embodiments, the spacing between the bars is of course such that entry of the ball being used in the game is prevented from passing through the grid formed by the bars.

DETAILED DESCRIPTION OF THE INVENTION AND PREFERRED EMBODIMENTS THEREOF

According to a first embodiment, the present invention provides a face mask for the prevention of facial injury formed as an integrally molded plastic structure with interconnected horizontal bars, vertical bars and panels. The lowest of the horizontal bars is appended to and is formed integral with a solid chin panel extending downwardly. The face mask is preferably fabricated by injection molding and is formed of a tough and fairly rigid plastic resin, such as a polycarbonate resin having a high resistance to impact and ability to flex slightly without cracking under such impact.

Figure 1:
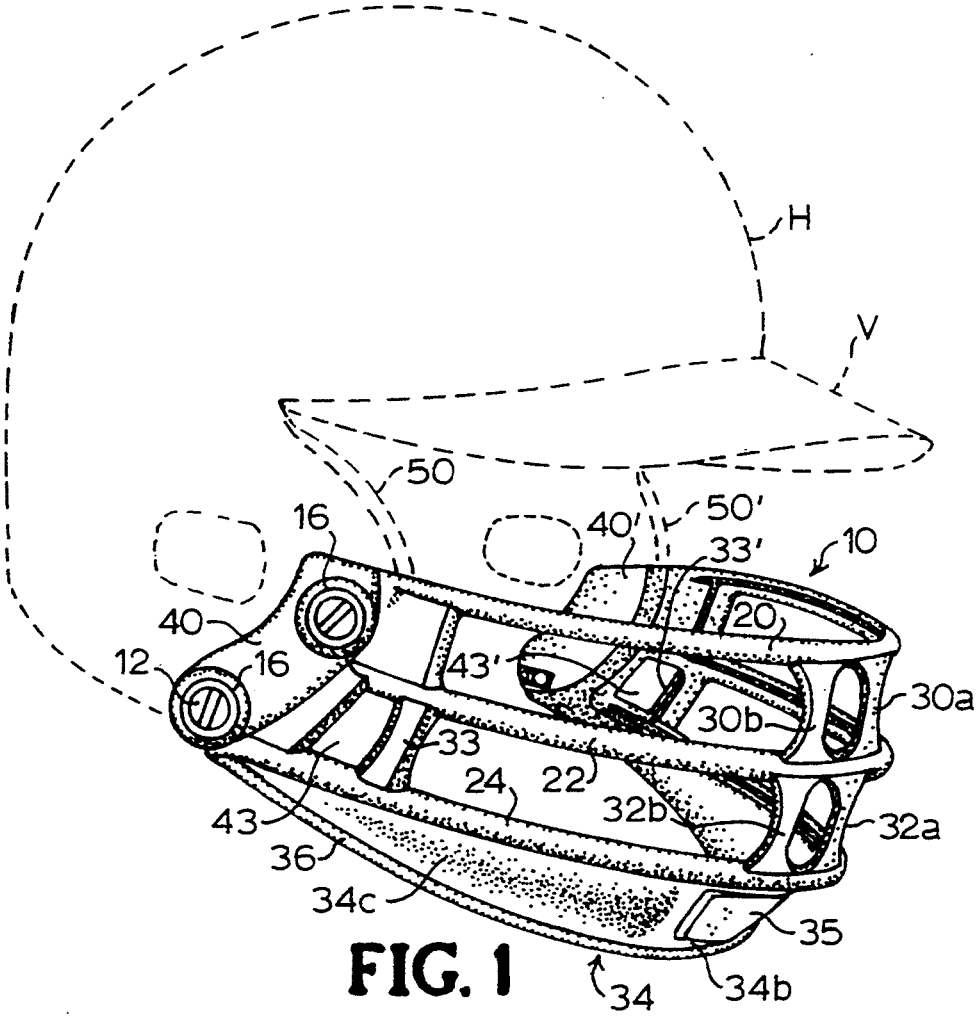
FIG. 1 is a perspective view of a first embodiment of the face mask of the invention mounted on and secured to a typical helmet (shown in dashed lines).
Figure 2:
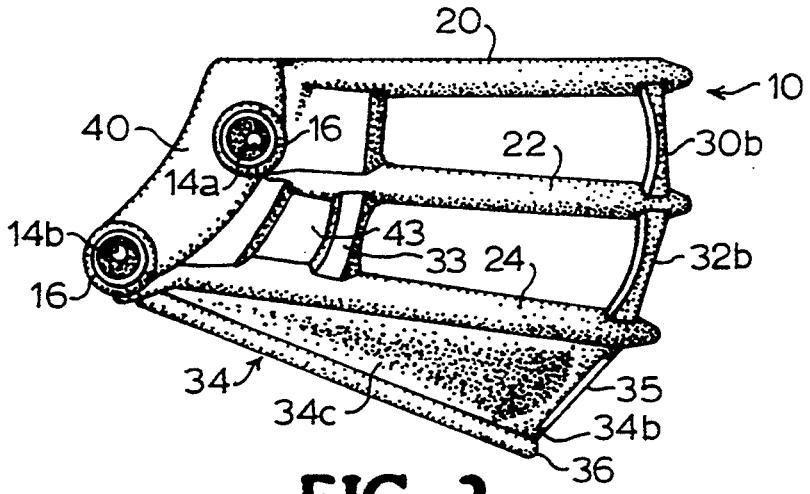
FIG. 2 is a right side elevation view of the dismounted face mask of FIG. 1.

Referring first to FIG. 1, face mask 10 is mounted on helmet H by means of fasteners 12 inserted into either side of helmet H. The preferred mounting means includes means adjoining fasteners 12 to affix a strap (not shown) adapted to secure the helmet H and mask 10 to the head of the player. U.S. Pat. No. 3,886,596, incorporated herein by reference, illustrates a suitable mounting structure.

Figure 3:
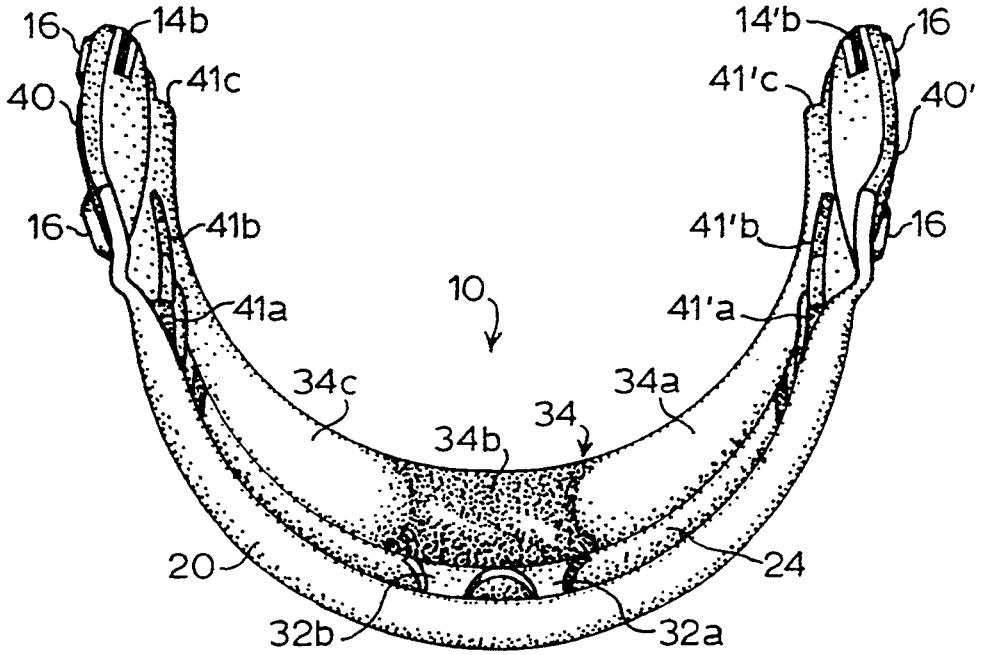
FIG. 3 is a top plan view of the dismounted face mask of FIG. 1.
Figure 6:
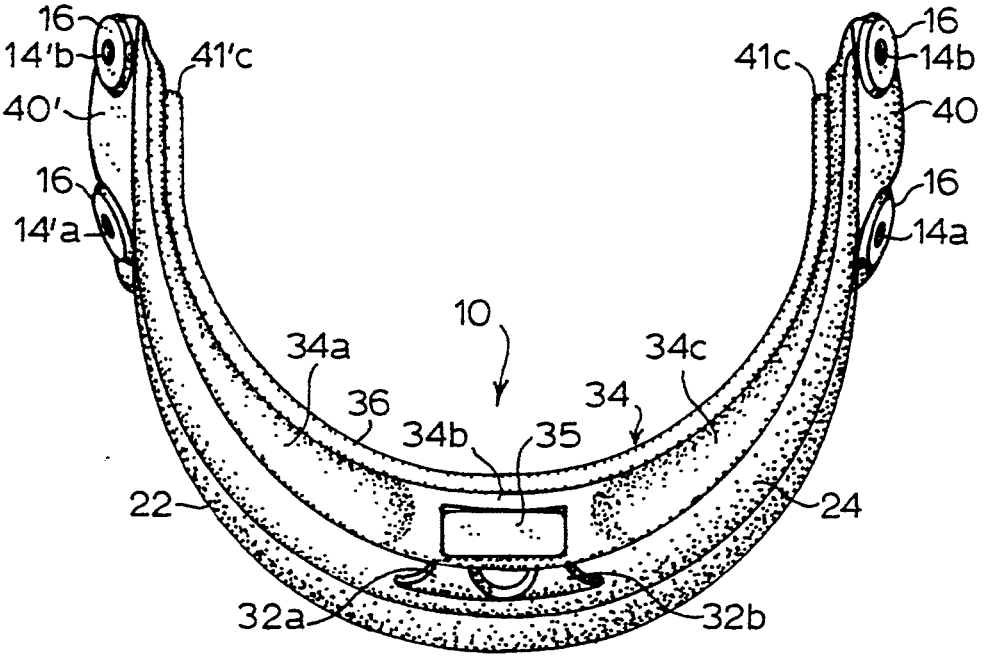
FIG. 6 is a bottom elevation view of the dismounted face mask of FIG. 1.
Figure 7:
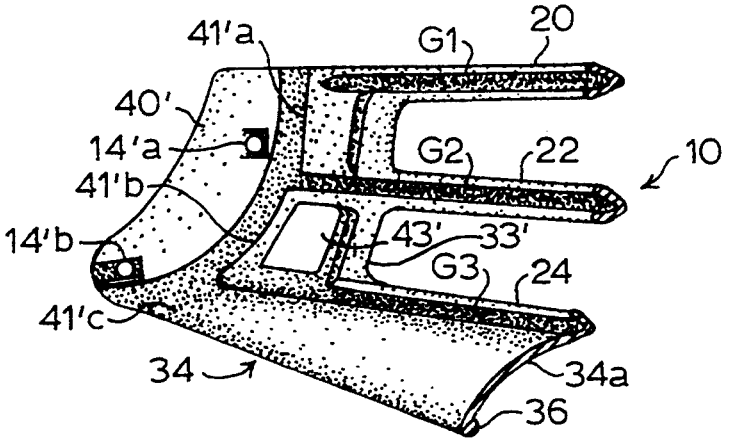
FIG. 7 is a cross section view taken along line 7—7 of FIG. 4.

The face mask 10 is formed in an arcuate shape, as seen in plan view in FIGS. 3 and 6, and extends forward beyond the face of the wearer. When worn with helmet H, face mask 10 is positioned at a height to permit complete peripheral vision above mask 10 and below the visor V of helmet H, while not permitting a baseball to pass therebetween.

Figure 4:
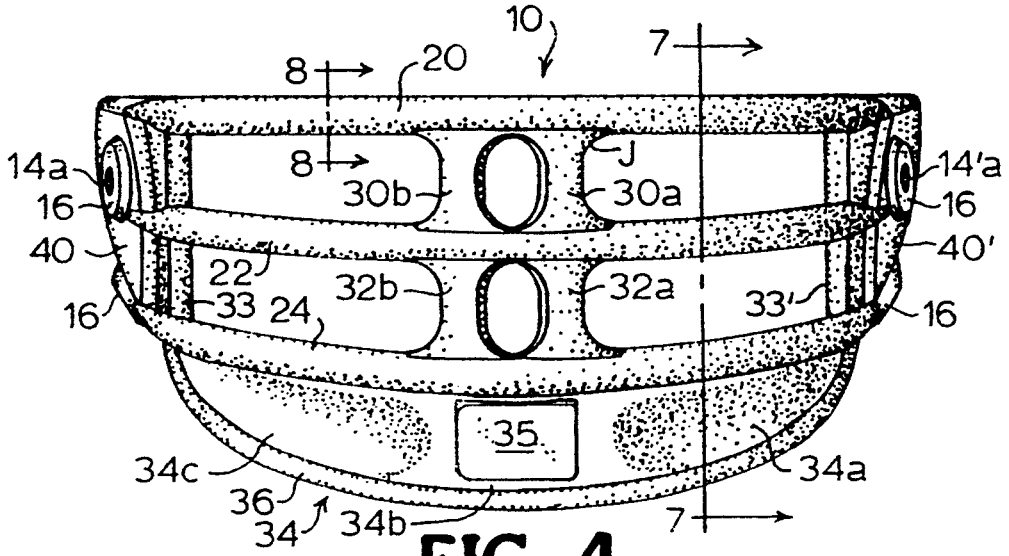
FIG. 4 is a front elevation view of the dismounted face mask of FIG. 1.
Figure 9:
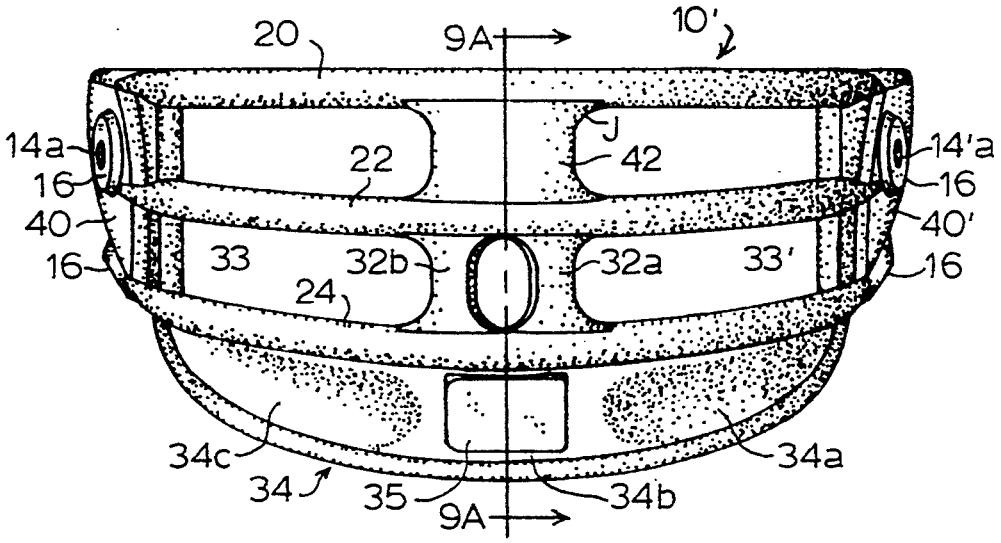
FIG. 9 is a front view of a second embodiment of the mask of the invention.
Figure 9A:
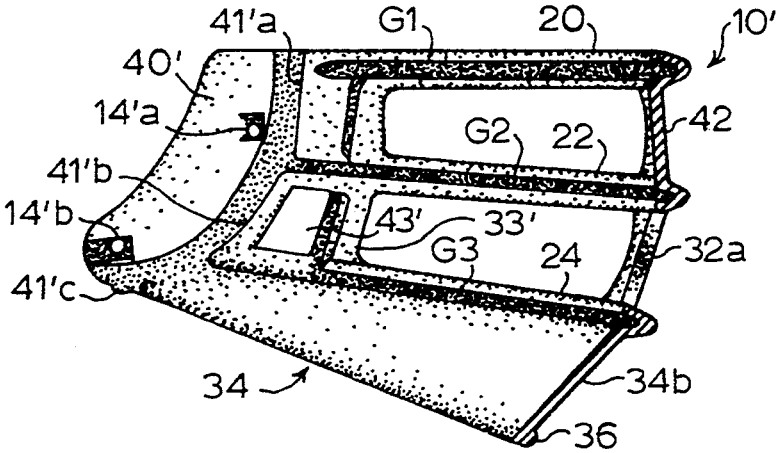
FIG. 9A is a cross section view taken along line 9A—9A of FIG. 9.

As seen in FIGS. 1–7, face mask 10 comprises as an integral molded structure a series of horizontal bars 20, 22, 24 and a formed, sheet-like chin panel 34 with interconnecting pairs of vertical bars 30*a*, 30*b* and 32*a*, 32*b*. Areas between the bars are open, providing ventilation. Upper bar 20, middle bar 22 and lower bar 24 are approximately equally spaced from each other and are mutually parallel. Upper vertical connecting bars 30*a* and 30*b* are aligned with lower vertical connecting bars 32*a* and 32*b*, adding strength to the middle portion of face mask 10 and maintaining the spacing between bars 20, 22, 24. Each vertical bar assumes an hour-glass like shape and each join J (FIG. 4) between a vertical and horizontal bar is curved which further enhances the overall strength of the mask 10. Upper vertical connecting bars 30*a* and 30*b* may be replaced with a single panel 42 as depicted in mask 10' in FIG. 9. Side panels 40, 40' are integrally formed with the lateral ends of bars 20, 22 and 24 and are co-figured to mount to helmet H (FIG. 1). Side panels 40', 41' have upper and lower mounting fastener holes 14*a*, 14*b* and 14', 14'*b* each surrounded by a boss 16 for strength. Openings 43, 43' bounded by vertical bars 33, 33' are formed on the side of each panel 40, 40'. Chin panel 34 is sheet-like and is divided into a tapered concave right chin panel 34*a*, a tapered concave left chin panel 34*c* and a planar central chin panel 34*b*. The lower border of chin panel 34 is formed as a circumferential bead 36. In the center of central chin panel 34*b* is planar name plate 35 adapted for embossed identification, not shown, as best seen in FIG. 4.

Figure 8A:
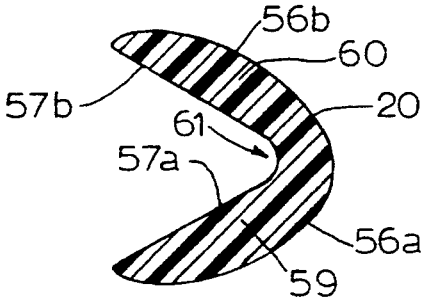
FIG. 8A is a cross section view taken along line 8—8 of FIG. 7 illustrating use of a "V" shaped cross section in the horizontal bars of FIG. 1.
Figure 8B:
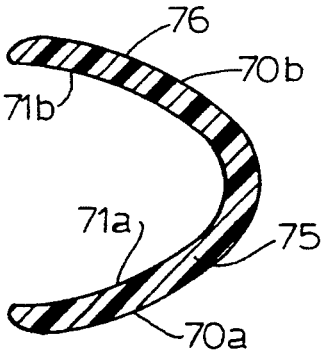
FIG. 8B is a cross section view similar to FIG. 8A and taken along line 8—8 of FIG. 7 but with the horizontal bar being formed with a "U" shaped cross section.
Figure 8C:
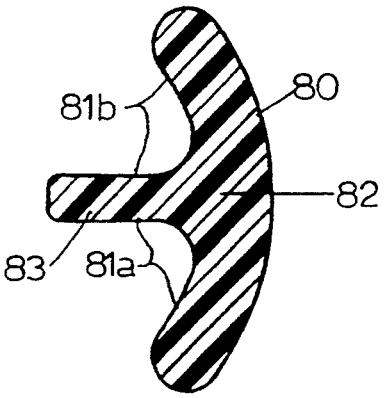
FIG. 8C is a cross section view similar to FIG. 8 and taken alone line 8—8 of FIG. 7 but with the horizontal bar being formed of a "T" shaped cross section.

The cross sectional shape of horizontal bars 20, 22 and 24 may be in any of the illustrative forms shown in FIGS. 8A, 8B and 8C each of which provides an easily molded rib-like construction which tends not to collect bubbles during molding and thus leads to a greatly strengthened construction. Making reference initially to FIG. 8A and using bar 20 for reference, horizontal bars 20, 22, and 24 have front, forwardly oriented, outwardly curved surfaces 56*a*, 56*b* respectively, and rear relatively flat surfaces 57*a*, 57*b* between which are formed the respective spaced apart, opposed and angularly related rib portions 59, 60 which extend rearwardly as shown in FIG. 8A.

In the embodiment depicted in FIG. 8A the two rib portions 59, 60 extend rearwardly to form an arcuate horizontal bar having a cross sectional shape of a horizontally forward pointing "V" shape having a curved trough 61.

In another embodiment as depicted in FIG. 8B the first, forwardly oriented, outwardly curved surfaces 70*a*, 70*b* and rear, curved surfaces 71*a*, 71*b* form two spaced apart, opposed and angularly related rib portions 75, 76 extending rearwardly to form an arcuate horizontal bar having a cross sectional shape substantially in the form of a horizontally forward pointing "U" shape.

In another embodiment as depicted in FIG. 8C the front, forwardly oriented, outwardly curved surface 80 and rear, curved surfaces 81*a*, 81*b* form an outwardly curved, arcuate, rib portion 82 and an appended centrally positioned, horizontal rearwardly directed rib portion 83 to form an arcuate horizontal bar having a cross sectional shape of a horizontally backward pointing "T" shape.

Each of the embodiments illustrated in FIGS. 8A, 8B, and 8C have respective forwardly oriented and rear surfaces which in each example form at least two rib portions which assume separate locations along the length of the bar and in each example the rib portions extend rearwardly and have sufficient thickness in the body of each such rib portion to optimize the impact resistance of the face mask 10 of the invention.

Figure 5:
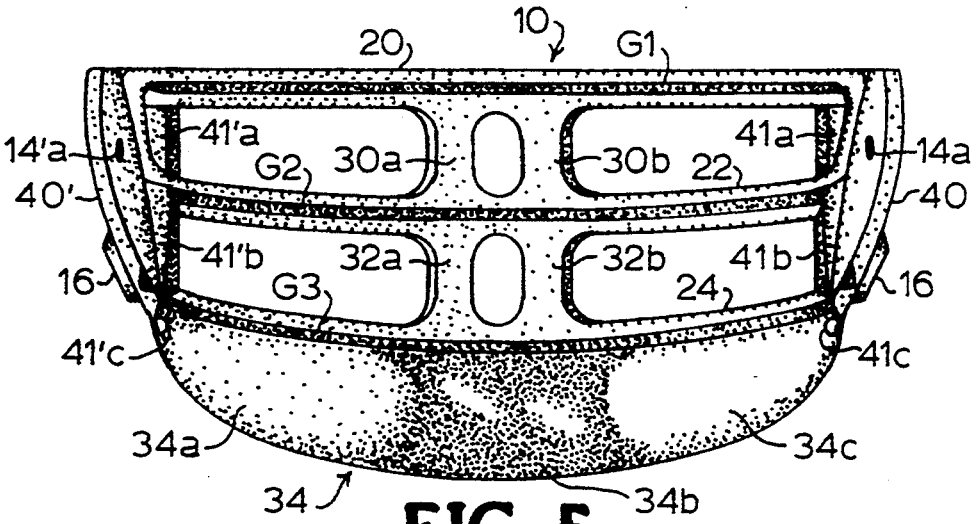
FIG. 5 is a rear elevation view of the dismounted face mask of FIG. 1.

Curved abuttments 41*a*, 41*b*, 41*c* and 41*a'*, 41*b'* and 41*c'* as depicted in FIGS. 3 and 5, are formed on the inner surface of each side panels 40, 40' and each such abuttment is adapted to engage the typical beads 50, 51' (FIG. 1) formed along the forward edge of the baseball helmet to which the mask 10 of the present invention is adapted to mount. By means of the engagement of the abuttments on the helmet beads 50, 50', the force of any impact against face mask 10 is distributed between the fastening means 12 (FIG. 1) and the abuttments in the manner set forth more fully in U.S. Pat. No. 3,886,596.

While not shown, it is to be understood that each of the vertical bars are also preferably formed with a cross-section such as that described with respect to the horizontal bars. Thus, the advantages of the invention are achieved both with respect to the vertical bars as well as the horizontal bars and overall in a construction which tends to minimize the forming of bubbles in the molding process, minimize the overall weight of the mask and provide increased overall impact strength and fracture resistance as compared to prior art grid type face masks.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A sports face mask adapted when secured to a helmet to protect the face of the wearer from impact of an incoming object, comprising;

(a) a plurality of arcuate substantially horizontal bars extending from a first end to a second end in substantially parallel vertically separated orientation, said bars having a cross-sectional shape selected from a substantially V, U or T configuration and in either case being defined by a front surface curved outwardly relative to the mask and continuous with said front surface, a rear curved surface, said front and rear surfaces serving as boundary surfaces for solid rib portions defining said selected shape and established by and located between said surfaces and extending in separate, spaced apart locations for the length of said bars; and (b) end panels integrally formed with said bars and mounting the respective said first and second ends of said bars, said end panels being adapted for securing said face mask to a sports helmet matable therewith.

2. A face mask as claimed in claim 1 including a selected number of vertical bars extending between selected of said horizontal bars and located intermediate the said first and second ends thereof.

3. A face mask as claimed in claim 2 wherein at least one said vertical bar also has a said cross-sectional shape similar to that of said horizontal bars.

4. A face mask as claimed in claim 2 further comprising an arcuate continuous chin panel appended to and formed integral with the lowermost of said horizontal bars and wherein said chin panel extends downwardly therefrom.

5. A face mask as claimed in claim 2 wherein said cross-sectional shape defines two opposed angularly related said rib portions extending rearwardly to form a arcuate horizontal bar having a cross sectional shape of a horizontally forward pointing "U".

6. A face mask as claimed in claim 2 wherein said cross-sectional shape defines two opposed angularly related said rib portions extending rearwardly to form an arcuate horizontal bar having a cross sectional shape of a modified "V" and wherein a rearwardly facing trough of said "V" is curved.

7. A face mask as claimed in claim 2 wherein said cross-sectional shape defines one forwardly positioned, arcuate said rib portion and another horizontal said rib portion extending rearwardly to form an arcuate horizontal bar having a cross section shape of a horizontally backward pointing "T".

8. A face mask as claimed in claim 2 further comprising a panel integral to and interposed between the uppermost of said horizontal bars and adjacent the next lower horizontal bar and being operative for strengthening said mask.

9. A face mask as claimed in claim 8 further comprising an arcuate continuous chin panel appended to and formed integral with the lowermost of said horizontal bars and wherein said chin panel extends downwardly therefrom.

10. A sports face mask adapted when secured to a helmet to protect the face of the wearer from impact of an incoming object, comprising;

(a) a plurality of arcuate substantially horizontal bars extending from a first end to a second end in substantially parallel vertically separated orientation, said bars having a cross-sectional shape defined by a front surface curved outward relative to the mask and continuous with said front surface, a rear surface curved outward relative to the mask, said front and rear surfaces serving as boundary surfaces for plural solid rib portions defining said shape and established by and located between said surfaces and extending in separate, spaced apart locations for the length of said bars; and (b) end panels integrally formed with said bars and mounting the respective said first and second ends of said bars, said end panels being adapted for securing said face mask to a sports helmet matable therewith.

* * * * *